US010770004B2

(12) United States Patent
Kim et al.

(10) Patent No.: US 10,770,004 B2
(45) Date of Patent: Sep. 8, 2020

(54) PIXEL CIRCUIT

(71) Applicant: Samsung Display Co., Ltd., Yongin-si, Gyeonggi-do (KR)

(72) Inventors: Sung Hwan Kim, Yongin-si (KR); Chul Kyu Kang, Yongin-si (KR); Soo Hee Oh, Yongin-si (KR); Dong Sun Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/563,636

(22) Filed: Sep. 6, 2019

(65) Prior Publication Data

US 2020/0143747 A1 May 7, 2020

(30) Foreign Application Priority Data

Nov. 6, 2018 (KR) ..... 10-2018-0135422

(51) Int. Cl.

| | |
|---|---|
| ***G09G 3/30*** | (2006.01) |
| ***G09G 3/32*** | (2016.01) |
| ***G09G 3/3266*** | (2016.01) |
| ***G09G 3/3291*** | (2016.01) |

(52) U.S. Cl.

CPC ..... *G09G 3/3266* (2013.01); *G09G 3/3291* (2013.01); *G09G 2310/027* (2013.01)

(58) Field of Classification Search

CPC ..... G09G 3/3266; G09G 3/3291; G09G 2310/027

See application file for complete search history.

(56) References Cited

U.S. PATENT DOCUMENTS

| | | | |
|---|---|---|---|
| 8,692,821 | B2 | 4/2014 | Park |
| 9,330,596 | B2 | 5/2016 | Choi et al. |
| 9,330,601 | B2 | 5/2016 | Lee et al. |
| 2015/0187270 | A1 | 7/2015 | Lee et al. |
| 2016/0217735 | A1 | 7/2016 | Park et al. |
| 2016/0379552 | A1 | 12/2016 | Kim et al. |

FOREIGN PATENT DOCUMENTS

| | | | |
|---|---|---|---|
| KR | 10-2009-0093073 | A | 9/2009 |
| KR | 10-2015-0076868 | A | 7/2015 |
| KR | 10-1779076 | B1 | 9/2017 |
| KR | 10-1791664 | B1 | 11/2017 |

OTHER PUBLICATIONS

EPO Partial Search Report dated Dec. 17, 2019, for corresponding the European Patent Application No. 19207554.7 (17 pages).

*Primary Examiner* — Wing H Chow

(74) *Attorney, Agent, or Firm* — Lewis Roca Rothgerber Christie LLP

(57) ABSTRACT

A pixel circuit, includes: an organic light-emitting diode; a first transistor coupled between a second node and a third node, wherein a gate electrode of the first transistor is coupled to a first node; a second transistor coupled between a data line and the second node, wherein a gate electrode of the second transistor is coupled to a first scan line; a fourth transistor coupled between the first node and an initialization power source, wherein a gate electrode of the fourth transistor is coupled to a second scan line; a fifth transistor coupled between a first power source and the second node, wherein a gate electrode of the fifth transistor is coupled to a first emission line; and a sixth transistor and an eighth transistor coupled in series between the third node and the organic light-emitting diode.

16 Claims, 9 Drawing Sheets

PIXEL CIRCUIT

CROSS-REFERENCE TO RELATED APPLICATION

The present application claims priority to and the benefit of Korean patent application number 10-2018-0135422 filed on Nov. 6, 2018, the entire disclosure of which is incorporated herein in its entirety by reference.

BACKGROUND

1. Field

Aspects of some example embodiments of the present disclosure relate to a pixel circuit.

2. Related Art

With the development of information technology, the importance of a display device, which is a connecting medium between information and users, is being emphasized. Accordingly, the use of display devices, such as liquid crystal display devices, organic light-emitting display devices, plasma display devices, and the like, is increasing.

An organic light-emitting display device is configured to display images using organic light-emitting diodes, which generate light through the recombination of electrons and holes, and generally has a relatively fast response time and may be driven with relatively low power consumption.

A method in which the driving transistor of a pixel circuit, which drives an organic light-emitting diode, is set to an on-bias state in advance may be utilized as a method for solving a hysteresis issue and a step-efficiency issue.

The Background section of the present Specification includes information that is intended to provide context to example embodiments, and the information in the present Background section does not necessarily constitute prior art.

SUMMARY

Aspects of some example embodiments of the present disclosure are directed to a pixel circuit that may be capable of preventing or reducing unintended light emission and generation of overcurrent and reducing power consumption by setting the driving transistor thereof to an on-bias state.

According to some example embodiment of the present disclosure, a pixel circuit may include an organic light-emitting diode, a first transistor coupled between a second node and a third node and configured such that the gate electrode thereof is coupled to a first node, a second transistor coupled between a data line and the second node and configured such that the gate electrode thereof is coupled to a first scan line, a fourth transistor coupled between the first node and an initialization power source and configured such that the gate electrode thereof is coupled to a second scan line, a fifth transistor coupled between a first power source and the second node and configured such that the gate electrode thereof is coupled to a first emission line, and a sixth transistor and an eighth transistor coupled in series between the third node and the organic light-emitting diode, the sixth transistor being configured such that the gate electrode thereof is coupled to the first emission line, and the eighth transistor being configured such that the gate electrode thereof is coupled to a second emission line. Here, the phase of a first emission signal applied to the first emission line may be delayed relative to the phase of a second emission signal applied to the second emission line.

The sixth transistor may be coupled between the third node and one electrode of the eighth transistor, and the eighth transistor may be coupled between one electrode of the sixth transistor and the organic light-emitting diode.

The eighth transistor may be coupled between the third node and one electrode of the sixth transistor, and the sixth transistor may be coupled between one electrode of the eighth transistor and the organic light-emitting diode.

The pixel circuit may further include a third transistor coupled between the first node and the third node and configured such that the gate electrode thereof is coupled to the first scan line.

The third transistor may include a plurality of third sub-transistors that are coupled in series between the first node and the third node, and the fourth transistor may include a plurality of fourth sub-transistors that are coupled in series between the first node and the initialization power source.

The phase of a first scan signal applied to the first scan line may be delayed relative to the phase of a second scan signal applied to the second scan line.

The turn-on level pulse of the first scan signal may overlap the turn-off level pulse of the first emission signal, and the turn-on level pulse of the second scan signal may overlap the turn-off level pulse of the second emission signal.

The turn-on level pulse of the second scan signal may be generated when the first emission signal is at a turn-on level.

The pixel circuit may further include a seventh transistor coupled between the initialization power source and the organic light-emitting diode and configured such that the gate electrode thereof is coupled to a third scan line.

The phase of a third scan signal applied to the third scan line may be identical to the phase of a second scan signal applied to the second scan line.

The phase of a second scan signal applied to the second scan line may be delayed relative to the phase of a third scan signal applied to the third scan line.

The phase of a third scan signal applied to the third scan line may be delayed relative to the phase of a second scan signal applied to the second scan line.

The pixel circuit may further include a storage capacitor coupled between the first power source and the first node.

The pixel circuit may further include a first gate insulating layer configured to cover the source electrodes, the drain electrodes, and the channels of the first, second, fourth to sixth, and eighth transistors, and the gate electrodes of the first, second, fourth to sixth, and eighth transistors, the first and second scan lines, and the first and second emission lines may be located on the first gate insulating layer.

The second scan line, the first scan line, the first emission line, and the second emission line may be sequentially located in a first direction on an identical plane.

The second emission line may perpendicularly overlap the source electrode and the drain electrode of the eighth transistor.

DETAILED DESCRIPTION

Figure 1:
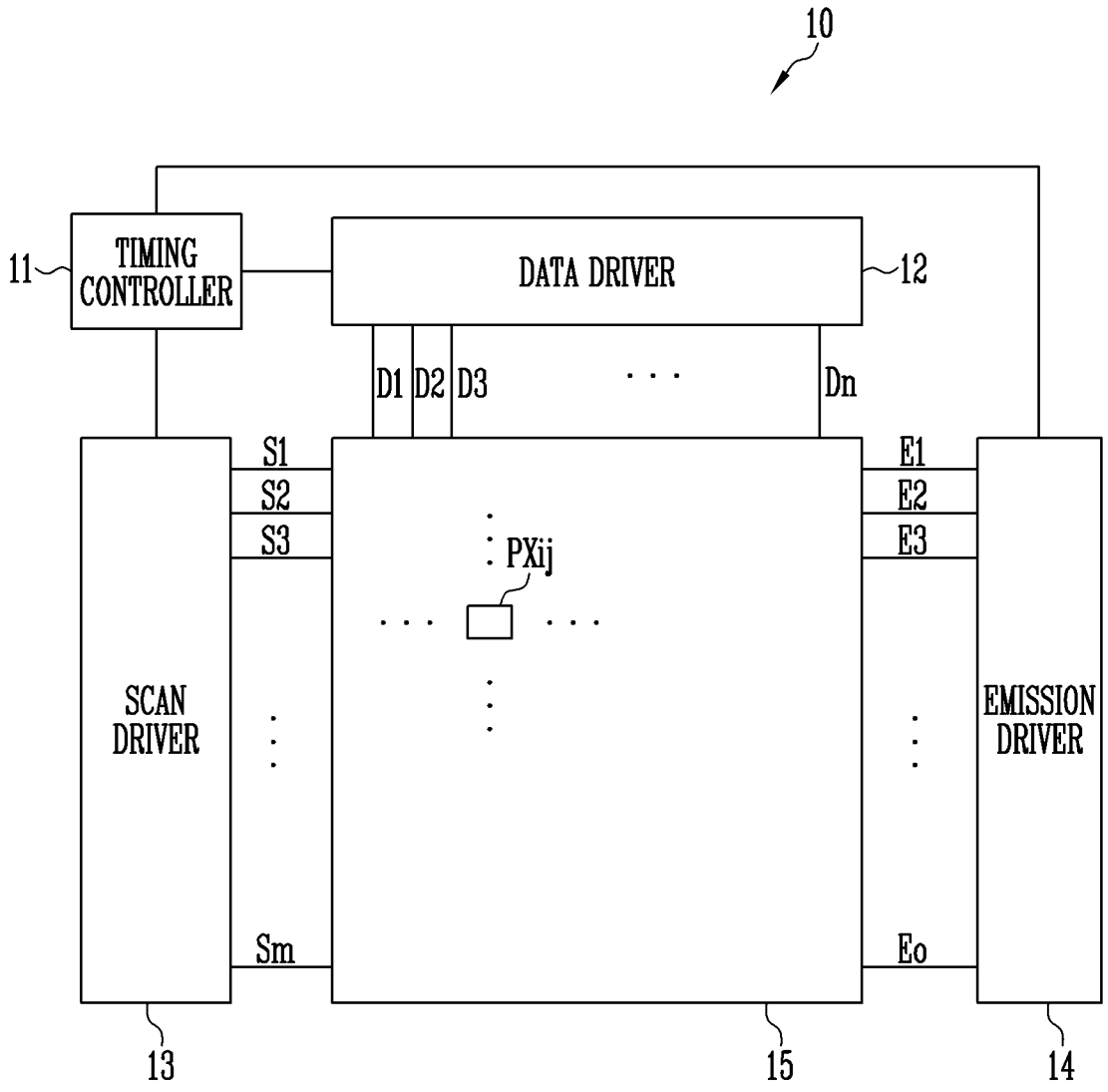
FIG. 1 is a diagram illustrating a display device according to some example embodiments of the present disclosure.

Aspects of some example embodiments are illustrated and described in the detailed description and the accompanying drawings.

The characteristics and features of some example embodiments of the present disclosure and methods of achieving them will be more apparent from the following example embodiments to be described in more detail with reference to the accompanying drawings. However, it should be noted that the present disclosure is not limited to the following example embodiments, and may be implemented in various forms. It is also noted that in this specification, "connected/coupled" refers to one component not only directly coupling another component but also electrically coupling another component through an intermediate component. Also, in the drawings, portions unrelated to the present disclosure will be omitted in order to clarify the description of the present disclosure, and the same reference numerals refer to like elements throughout.

FIG. 1 is a view illustrating a display device according to some example embodiments of the present disclosure.

Referring to FIG. 1, the display device 10 may include a timing controller 11, a data driver 12, a scan driver 13, an emission driver 14, and a pixel unit 15.

The timing controller 11 may provide grayscale values and control signals to the data driver 12 so as to be suitable for the specifications of the data driver 12. Also, the timing controller 11 may provide a clock signal, a scan start signal, and the like to the scan driver 13 so as to be suitable for the specifications of the scan driver 13. Also, the timing controller 11 may provide a clock signal, an emission stop signal, and the like to the emission driver 14 so as to be suitable for the specifications of the emission driver 14.

The data driver 12 may generate data signals to be provided to data lines D1 to Dn using grayscale values and control signals, which are received from the timing controller 11. For example, the data driver 12 may sample the grayscale values using a clock signal and apply data voltages, corresponding to the grayscale values, to the data lines D1 to Dn as the data signals. Here, n may be a natural number greater than zero.

The scan driver 13 may receive a clock signal, a scan start signal, and the like from the timing controller 11 and generate scan signals to be provided to scan lines S1 to Sm. For example, the scan driver 13 may sequentially provide scan signals, each having a turn-on level pulse, to the scan lines S1 to Sm. For example, the scan driver 13 may take the form of a shift register, and may generate scan signals such that a scan start signal in the form of a turn-on level pulse is sequentially delivered to the next stage circuit under the control of the clock signal. Here, m may be a natural number greater than zero.

The emission driver 14 may receive a clock signal, an emission stop signal, and the like from the timing controller 11 and generate emission signals to be provided to emission lines E1 to Eo. For example, the emission driver 14 may sequentially provide emission signals, each having a turn-off level pulse, to the emission lines E1 to Eo. For example, the emission driver 14 may take the form of a shift register, and may generate emission signals such that an emission stop signal in the form of a turn-off level pulse is sequentially delivered to the next stage circuit under the control of the clock signal. Here, o may be a natural number greater than zero.

The pixel unit 15 includes pixel circuits. Each pixel circuit PXij may be coupled to a data line, a scan line, and an emission line corresponding thereto. The configuration and the driving method of the pixel circuit PXij will be described in detail below. Here, i and j may be natural numbers greater than zero.

Figure 2:
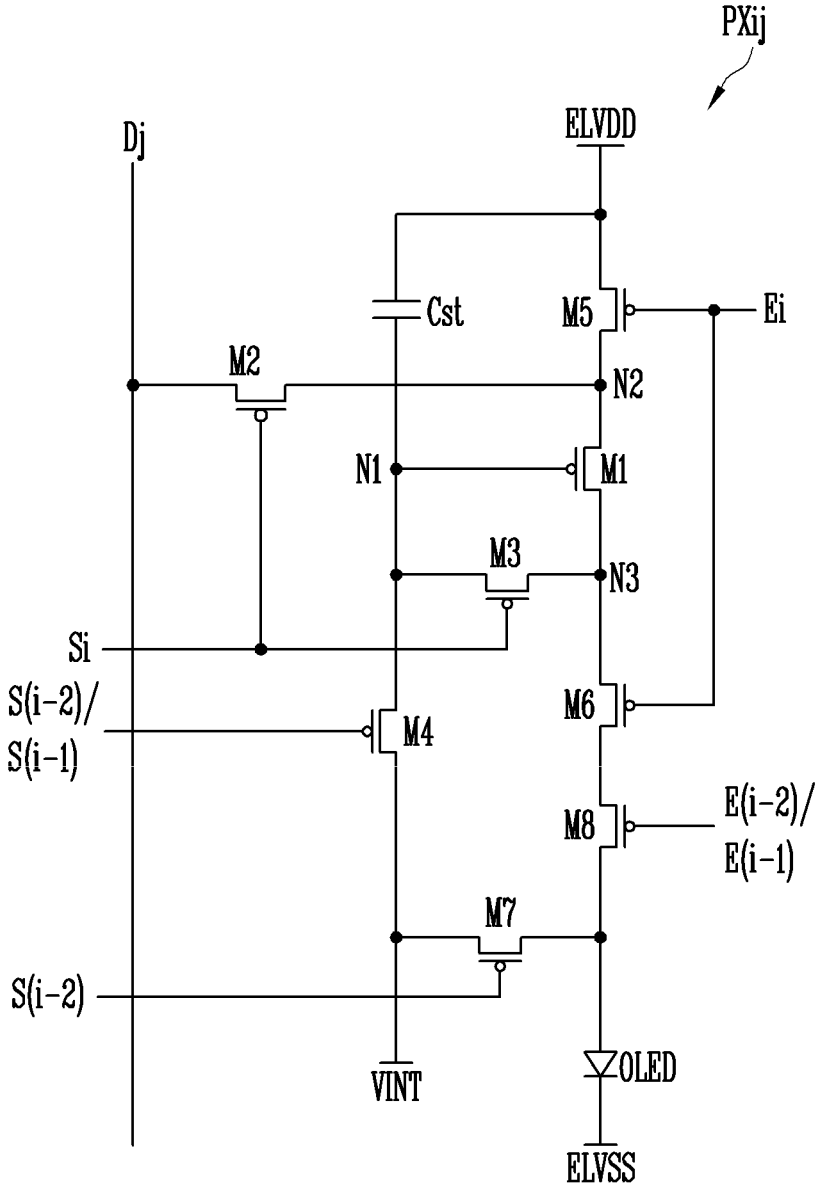
FIG. 2 is a diagram illustrating a pixel circuit according to some example embodiments of the present disclosure.
Figure 3:
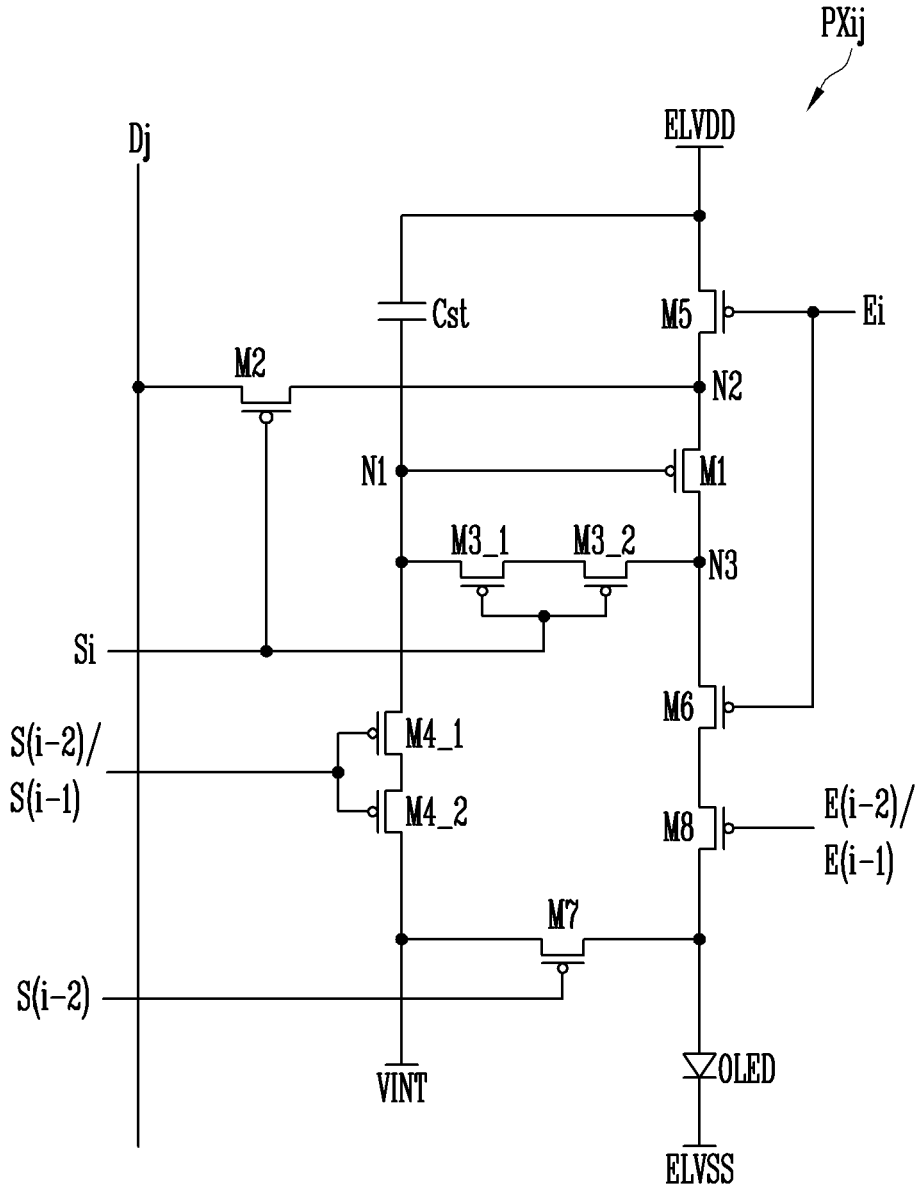
FIG. 3 is a diagram illustrating a pixel circuit according to some example embodiments of the present disclosure.
Figure 4:
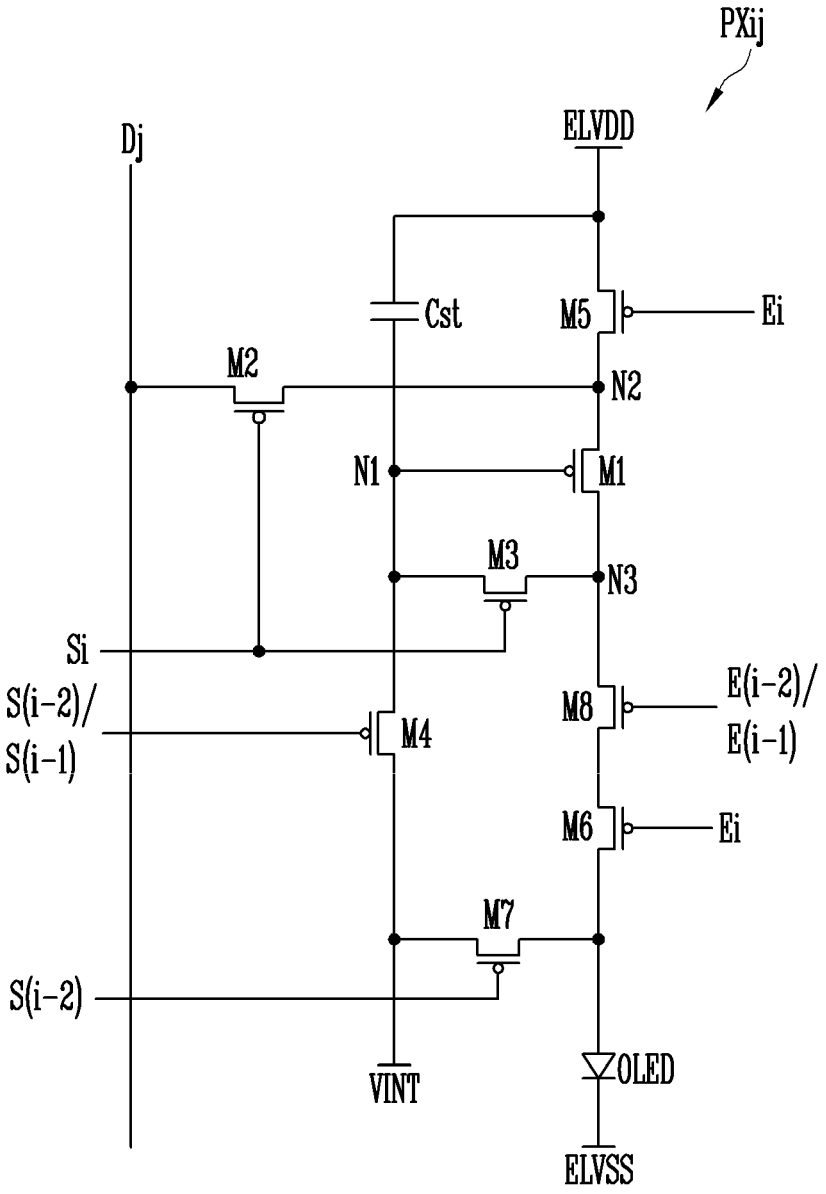
FIG. 4 is a diagram illustrating a pixel circuit according to some example embodiments of the present disclosure.

FIG. 2 is a diagram illustrating a pixel circuit according to some example embodiments of the present disclosure, FIG. 3 is a diagram illustrating a pixel circuit according to some example embodiments of the present disclosure, and FIG. 4 is a diagram illustrating a pixel circuit according to some example embodiments of the present disclosure.

Referring to FIGS. 2 to 4, a pixel circuit PXij includes first to eighth transistors M1 to M8, a storage capacitor Cst, and an organic light-emitting diode OLED.

The first transistor M1 is coupled between a second node N2 and a third node N3. The gate electrode of the first transistor M1 is coupled to a first node N1. The first transistor M1 may be turned on or off in response to the voltage of the first node N1. The first transistor M1 may be referred to as a driving transistor.

The second transistor M2 is coupled between a data line Dj and the second node N2. The gate electrode of the second transistor M2 is coupled to a first scan line Si. The second transistor M2 may be turned on or off in response to a first scan signal supplied to the first scan line Si. The second transistor M2 may be referred to as a scan transistor or a switching transistor.

The third transistor M3 is coupled between the first node N1 and the third node N3. The gate electrode of the third transistor M3 is coupled to the first scan line Si. The third transistor M3 may be turned on or off in response to the first scan signal supplied to the first scan line Si. According to some example embodiments, the third transistor M3 may include a plurality of sub-transistors M3_1 and M3_2 that are coupled in series in order to prevent leakage current, as shown in FIG. 3.

The fourth transistor M4 is coupled between the first node N1 and an initialization power source VINT. The gate electrode of the fourth transistor M4 is coupled to a second scan line S(i−1) or a third scan line S(i−2). The fourth transistor M4 may be turned on or off in response to a second scan signal supplied to the second scan line S(i−1) or a third scan signal supplied to the third scan line S(i−2). Also, according to an embodiment, the fourth transistor M4 may include a plurality of sub-transistors M4_1 and M4_2 that are coupled in series in order to prevent leakage current, as shown in FIG. 3.

The fifth transistor M5 is coupled between a first power source ELVDD and the second node N2. The gate electrode of the fifth transistor M5 is coupled to a first emission line Ei. The fifth transistor M5 may be turned on or off in response to a first emission signal supplied to the first emission line Ei.

The sixth transistor M6 is coupled between the third node N3 and the anode electrode of the organic light-emitting diode OLED. The gate electrode of the sixth transistor M6 is coupled to the first emission line Ei. The sixth transistor M6 may be turned on or off in response to the first emission signal supplied to the first emission line Ei.

The seventh transistor M7 is coupled between the initialization power source VINT and the anode electrode of the organic light-emitting diode OLED. The gate electrode of the seventh transistor M7 is coupled to the third scan line S(i−2). The seventh transistor M7 may be turned on or off in response to the third scan signal supplied to the third scan line S(i−2). According to some example embodiments, the gate electrode of the seventh transistor M7 may be alternatively coupled to the second scan line S(i−1).

The eighth transistor M8 is coupled between the third node N3 and the anode electrode of the organic light-emitting diode OLED. In some example embodiments of the present disclosure, the eighth transistor M8 may be coupled between the sixth transistor M6 and the anode electrode of the organic light-emitting diode OLED, as shown in FIG. 2. Alternatively, in some example embodiments of the present disclosure, the eighth transistor M8 may be coupled between the third node N3 and the sixth transistor M6, as shown in FIG. 4.

The gate electrode of the eighth transistor M8 is coupled to a second emission line. The eighth transistor M8 may be turned on or off in response to a second emission signal supplied to the second emission line. Here, the second emission line may be, for example, the (i−1)-th emission line E(i−1) or the (i−2)-th emission line E(i−2).

The storage capacitor Cst is coupled between the first power source ELVDD and the first node N1.

The organic light-emitting diode OLED may be configured such that the anode electrode thereof is coupled to one electrode of the seventh transistor M7 and one electrode of the eighth transistor M8 and such that the cathode electrode thereof is coupled to a second power source ELVSS.

The first emission signal applied to the first emission line Ei may differ from the second emission signal applied to the second emission line E(i−1) or E(i−2). For example, the first emission line Ei may be the i-th emission line E(i), and the second emission line may be the (i−2)-th emission line E(i−2).

The first scan signal applied to the first scan line Si may differ from the second scan signal applied to the second scan line S(i−1). For example, the first scan line Si may be the i-th scan line, and the second scan line S(i−1) may be the (i−1)-th scan line.

The third scan signal applied to the third scan line S(i−2) may differ from the first and second scan signals. For example, the third scan line S(i−2) may be the (i−2)-th scan line.

Figure 5:
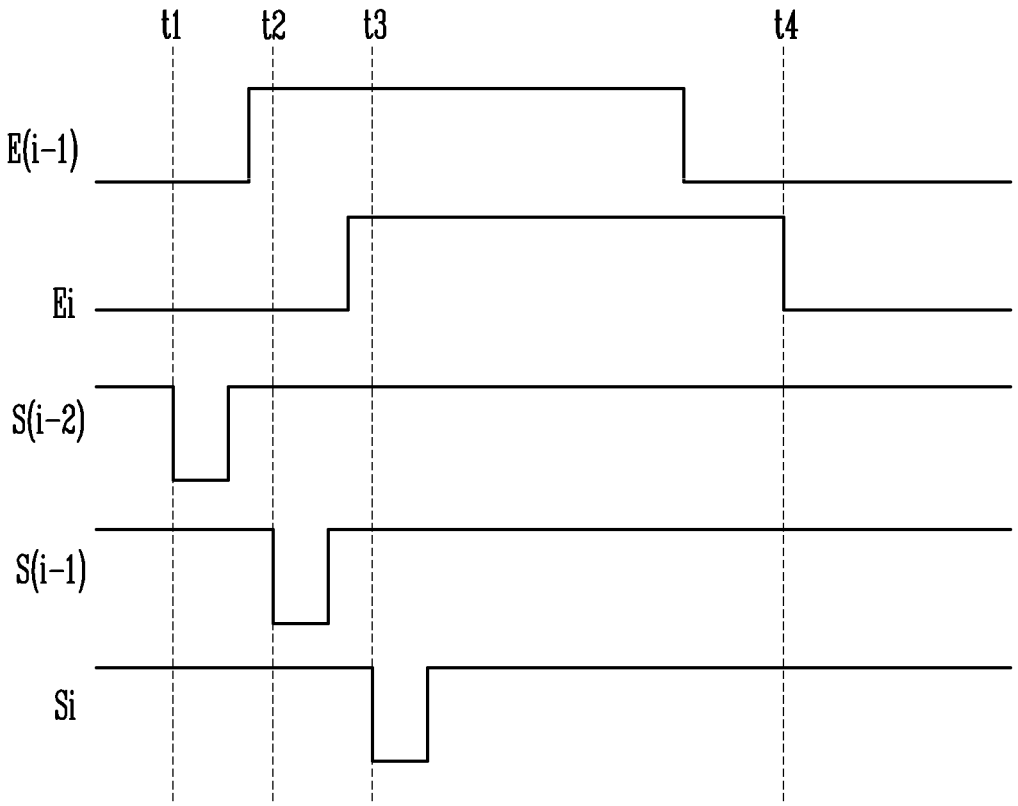
FIG. 5 is a diagram illustrating a method for driving a pixel circuit according to some example embodiments of the present disclosure.

FIG. 5 is a diagram illustrating a method for driving a pixel circuit according to some example embodiments of the present disclosure. In FIG. 5, a method for driving a pixel circuit in which the second emission line of FIG. 2 is the (i−1)-th emission line E(i−1) and in which the gate electrode of the fourth transistor M4 is coupled to the second scan line S(i−1) is illustrated.

Referring to FIG. 2 and FIG. 5, the first emission signal applied to the first emission line Ei, the second emission signal applied to the second emission line E(i−1), the first scan signal applied to the first scan line Si, the second scan signal applied to the second scan line S(i−1), and the third scan signal applied to the third scan line S(i−2) are illustrated.

The phase of the first emission signal may be delayed relative to the phase of the second emission signal. The phase of the first scan signal may be delayed relative to the phase of the second scan signal, and the phase of the second scan signal may be delayed relative to the phase of the third scan signal.

A period during which the pulse of the third scan signal has a turn-on level may overlap a period during which the pulse of the first emission signal has a turn-off level. A period during which the pulse of the third scan signal has the turn-on level may overlap a period during which the pulse of the second emission signal has the turn-off level. The turn-on level pulse of the second scan signal may be generated when the second emission signal is at the turn-off level. The turn-on level pulse of the first scan signal may be generated when the first and second emission signals are at the turn-off level.

First, the third scan signal is switched to the turn-on level at a first time point t1.

In response to the third scan signal, the seventh transistor M7 is turned on. Accordingly, the anode electrode of the organic light-emitting diode OLED is coupled to the initialization power source VINT, and electric charge stored in the anode electrode is initialized to the voltage of the initialization power source VINT.

Meanwhile, because the first and second emission signals are at the turn-on level at the first time point t1, the fifth, sixth, and eighth transistors M5, M6 and M8 maintain the turn-on state. Accordingly, a current path that connects the first power source ELVDD, the fifth, first, sixth, eighth, and seventh transistors M5, M1, M6, M8 and M7, and the initialization power source VINT may be generated. However, because the fourth transistor M4 in the turn-off state prevents the voltage of the initialization power source from being applied to the gate electrode of the first transistor M1 at the first time point t1, overcurrent does not flow in the current path. That is, because a data voltage corresponding to a relevant grayscale is being applied to the gate electrode of the first transistor M1, the amount of current corresponding to the grayscale flows therein, whereby the amount of consumed current is not increased.

At a second time point t2, the second scan signal is switched to the turn-on level, and the second emission signal is at the turn-off level.

In response to the second scan signal and the second emission signal, the fourth transistor M4 is turned on and the eighth transistor M8 is turned off. Because the fourth transistor M4 is turned on, the voltage of the initialization power source VINT is applied to the first node N1, that is, the gate electrode of the first transistor M1. Because the voltage of the initialization power source VINT is set lower than the turn-on level, the first transistor M1 may be turned on. Here, the fifth transistor M5 and the sixth transistor M6 are in the turn-on state by the first emission signal at the turn-on level. Accordingly, one electrode of the first transistor M1 is coupled to the first power source ELVDD, and the gate electrode thereof is coupled to the initialization power source VINT, whereby the first transistor M1 is set to an on-bias state.

Meanwhile, because the eighth transistor M8 in the turn-off state interrupts the current path that connects the fifth, first, sixth, and seventh transistors M5, M1, M6, and M7, and the initialization power source VINT, incidences of an increase in the amount of consumed current may be prevented or reduced.

Also, because the eighth transistor M8 is turned off, the organic light-emitting diode OLED does not emit light, whereby unintended light emission is prevented in the organic light-emitting diode OLED during the on-bias state. For example, when it is necessary for a pixel circuit PXij to display a black grayscale in a corresponding frame, the organic light-emitting diode OLED may emit light so as to be suitable for the target luminance.

Also, not the data voltage of the previous step, which changes each frame, but the same voltage of the initialization power source is applied to the gate electrode of the first transistor M1, whereby the first transistor M1 may be stably set to the on-bias state.

At a third time point t3, the first scan signal is switched to the turn-on level, and the first and second emission signals are at the turn-off level.

In response to the first scan signal and the first and second emission signals, the second and third transistors M2 and M3 are turned on, and the fifth, sixth, and eighth transistors M5, M6 and M8 are turned off. Because the second and third transistors M2 and M3 are turned on, a data signal is applied to one electrode of the storage capacitor Cst via the data line Dj and the second, first, and third transistors M2, M1 and M3, and the storage capacitor Cst stores the difference between the voltage of the data signal and the voltage of the first power source ELVDD. Here, the reduced threshold voltage of the first transistor M1 may be reflected in the stored voltage.

Subsequently, when the second and first emission signals are sequentially set to the turn-on state at a fourth time point t4, the eighth transistor M8 is turned on, and then the fifth and sixth transistors M5 and M6 are turned on. Accordingly, a current path that connects the first power source ELVDD, the fifth, sixth, and eighth transistors M5, M6, and M8, the organic light-emitting diode OLED, and the second power source ELVSS is generated. The amount of current flowing in the current path may be set depending on the voltage stored in the storage capacitor Cst that is coupled to the gate electrode of the first transistor Ml.

Figure 6:
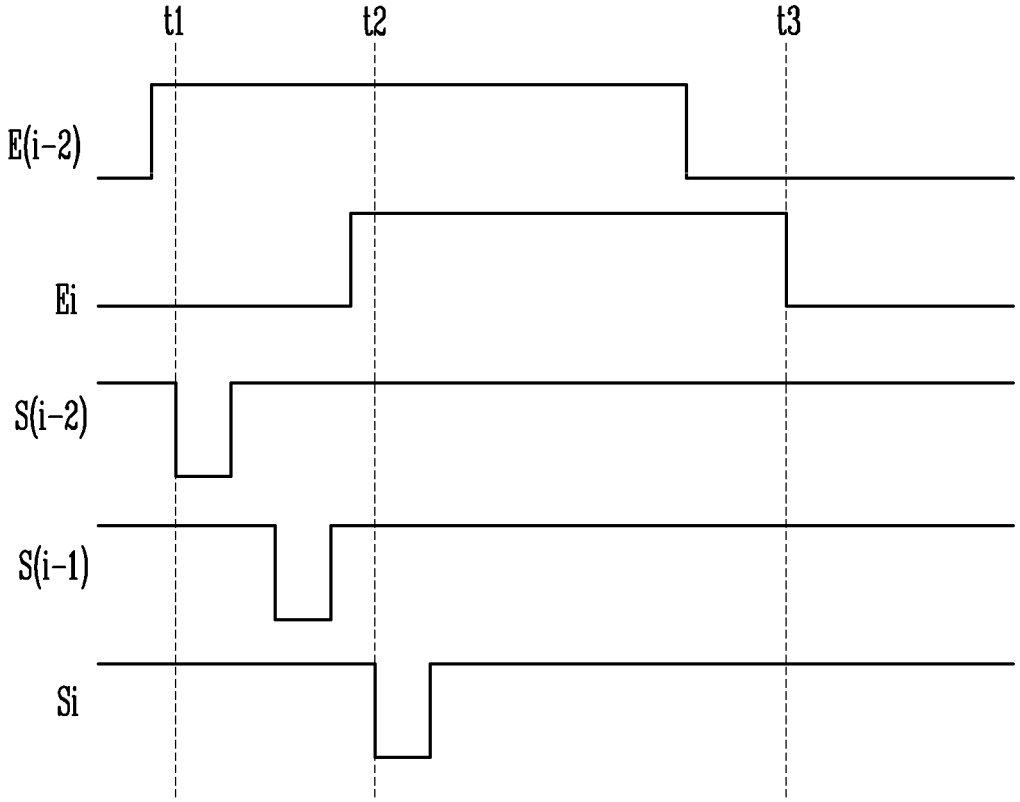
FIG. 6 is a diagram illustrating a method for driving a pixel circuit according to some example embodiments of the present disclosure.

FIG. 6 is a diagram illustrating a method for driving a pixel circuit according to some example embodiments of the present disclosure. In FIG. 6, a method for driving a pixel circuit in which the second emission line of FIG. 2 is the (i−2)-th emission line E(i−2) and in which the gate electrode of the fourth transistor M4 is coupled to the third scan line S(i−2) is illustrated.

Referring to FIG. 2 and FIG. 6, the first emission signal applied to the first emission line Ei, the second emission signal applied to the second emission line E(i−2), the first scan signal applied to the first scan line Si, and the third scan signal applied to the third scan line S(i−2) are illustrated. The second scan signal applied to the second scan line S(i−1) is illustrated in order to compare the phase thereof with the phases of the first scan signal and the third scan signal.

The phase of the first emission signal may be delayed relative to the phase of the second emission signal. The phase of the first scan signal may be delayed relative to the phase of the second scan signal.

A period during which the pulse of the third scan signal has the turn-on level may overlap a period during which the pulse of the second emission signal has the turn-off level. A period during which the pulse of the second scan signal has the turn-on level may overlap a period during which the pulse of the second emission signal has the turn-off level. The turn-on level pulses of the third and second scan signals may be generated when the first emission signal is at the turn-on level. The turn-on level pulse of the first scan signal may be generated when the first and second emission signals are at the turn-off level.

First, at a first time point t1, the third scan signal is switched to the turn-on level, and the second emission signal is at the turn-off level.

In response to the third scan signal, the seventh transistor M7 is turned on. Accordingly, the anode electrode of the organic light-emitting diode OLED is coupled to the initialization power source VINT, and electric charge stored in the anode electrode is initialized to the voltage of the initialization power source VINT.

Also, in response to the third scan signal and the second emission signal, the fourth transistor M4 is turned on and the eighth transistor M8 is turned off. Because the fourth transistor M4 is turned on, the voltage of the initialization power source VINT is applied to the first node N1, that is, the gate electrode of the first transistor M1. Because the voltage of the initialization power source is set lower than the turn-on level, the first transistor M1 may be turned on. Here, the fifth transistor M5 and the sixth transistor M6 are in the turn-on state by the first emission signal at the turn-on level. One electrode of the first transistor M1 is coupled to the first power source ELVDD, and the gate electrode thereof is coupled to the initialization power source VINT, whereby the first transistor M1 is set to an on-bias state.

Meanwhile, the eighth transistor M8 in the turn-off state interrupts the current path that connects the fifth, first, sixth, and seventh transistors M5, M1, M6, and M7, and the initialization power source VINT, whereby incidences of an increase in the amount of consumed current may be prevented or reduced.

Also, because the eighth transistor M8 is turned off, the organic light-emitting diode OLED does not emit light, whereby unintended light emission is prevented in the organic light-emitting diode OLED during the on-bias state. For example, when it is necessary for a pixel circuit PXij to display a black grayscale in a corresponding frame, the organic light-emitting diode OLED may emit light so as to be suitable for the target luminance.

Also, not the data voltage of the previous step, which changes each frame, but the same voltage of the initialization power source is applied to the gate electrode of the first transistor M1, whereby the first transistor M1 may be stably set to the on-bias state.

At a second time point t2, the first scan signal is switched to the turn-on level, and the first and second emission signals are at the turn-off level.

In response to the first scan signal and the first and second emission signals, the second and third transistors M2 and M3 are turned on, and the fifth, sixth, and eighth transistors M5, M6, and M8 are turned off. Because the second and third transistors M2 and M3 are turned on, a data signal is applied to one electrode of the storage capacitor Cst via the data line Dj and the second, first, and third transistors M2, M1 and M3, and the storage capacitor Cst stores the difference between the voltage of the data signal and the voltage of the first power source ELVDD. Here, the reduced threshold voltage of the first transistor M1 may be reflected in the stored voltage.

Subsequently, when the second and first emission signals are sequentially set to the turn-on state at a third time point t3, the eighth transistor M8 is turned on, and then the fifth and sixth transistors M5 and M6 are turned on. Accordingly, a current path that connects the first power source ELVDD, the fifth, sixth, and eighth transistors M5, M6, and M8, the organic light-emitting diode OLED, and the second power source ELVSS is generated. The amount of current flowing in the current path may be set depending on the voltage stored in the storage capacitor Cst that is coupled to the gate electrode of the first transistor M1.

Figure 7:
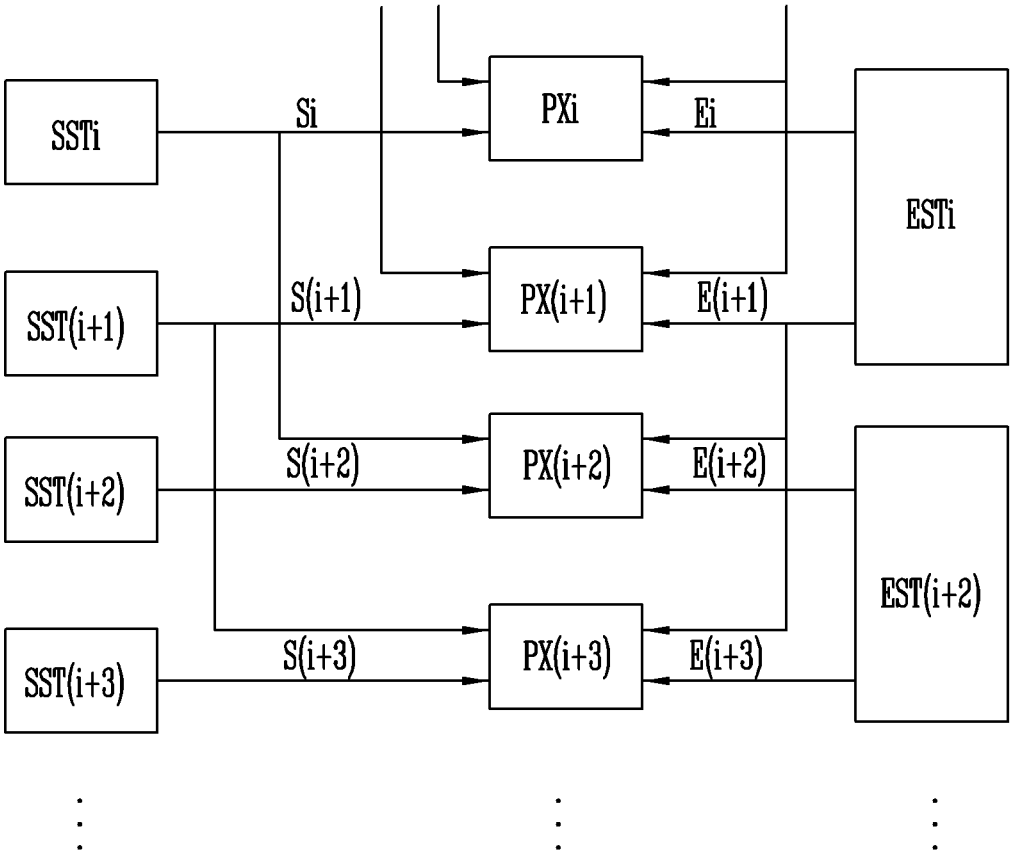
FIG. 7 is a diagram illustrating a coupling relationship between a scan driver and an emission driver according to the embodiment of FIG. 6.

FIG. 7 is a diagram illustrating a coupling relationship between a scan driver and an emission driver according to the embodiment of FIG. 6.

Referring to FIG. 7, in some example embodiments of the present disclosure, the scan driver 13 may include multiple stages SSTi, SST(i+1), SST(i+2), SST(i+3), . . . coupled to corresponding ones of pixel rows PXi, PX(i+1), PX(i+2), PX(i+3), . . . . Each of the stages SSTi, SST(i+1), SST(i+2), SST(i+3), . . . may operate as a shift register. The respective stages SSTi, SST(i+1), SST(i+2), SST(i+3), . . . may supply scan signals to the pixel rows PXi, PX(i+1), PX(i+2), PX(i+3), . . . corresponding thereto through the respective scan lines Si, S(i+1), S(i+2), S(i+3), . . . .

In some example embodiments of the present disclosure, each of the pixel rows PXi, PX(i+1), PX(i+2), PX(i+3), . . . may be supplied with a first scan signal from a corresponding one of the stages SSTi, SST(i+1), SST(i+2), SST(i+3), . . . through a corresponding one of the scan lines Si, S(i+1), S(i+2), S(i+3), . . . . Also, each of the pixel rows PXi, PX(i+1), PX(i+2), PX(i+3), . . . may be supplied with a second scan signal and/or a third scan signal from the previous stage. In the embodiment of FIG. 7, each of the pixel rows PXi, PX(i+1), PX(i+2), PX(i+3), . . . may be supplied with the (i−2)-th scan signal as the third scan signal by being coupled to the scan line of the stage before the previous stage.

In some example embodiments of the present disclosure, the emission driver 14 may include multiple stages ESTi, EST(i+2), . . . coupled to the pixel rows PXi, PX(i+1), PX(i+2), PX(i+3), . . . . In the present disclosure, each of the stages ESTi, EST(i+2), . . . is coupled to two pixel rows selected from among the pixel rows PXi, PX(i+1), PX(i+2), PX(i+3), . . . . Each of the stages ESTi, EST(i+2), . . . may supply an emission signal to pixel rows corresponding thereto, among the pixel rows PXi, PX(i+1), PX(i+2), PX(i+3), . . . through emission lines corresponding thereto, among the emission lines Ei, E(i+1), E(i+2), E(i+3), . . . . In this embodiment, emission signals that are supplied to two pixel rows coupled to the same stage may have the same waveform.

In some example embodiments of the present disclosure, each of the pixel rows PXi, PX(i+1), PX(i+2), PX(i+3), . . . may be supplied with a first emission signal from the stage corresponding thereto, among the stages ESTi, EST(i+2), . . . through emission lines corresponding thereto, among the emission line Ei, E(i+1), E(i+2), E(i+3), . . . . Also, each of the pixel rows PXi, PX(i+1), PX(i+2), PX(i+3), . . . may be supplied with a second emission signal from the previous stage.

In the embodiment of FIG. 7, each of the pixel rows PXi, PX(i+1), PX(i+2), PX(i+3), . . . may be supplied with the second emission signal by being coupled to the emission line of the previous stage or the stage before the previous stage. For example, in FIG. 7, the (i+2)-th pixel row PX(i+2) is supplied with the (i−1)-th emission signal by being coupled to the second emission line E(i+1), and the (i+3)-th pixel row PX(i+3) may be supplied with the (i−2)-th emission signal by being coupled to the second emission line E(i+1).

Figure 8:
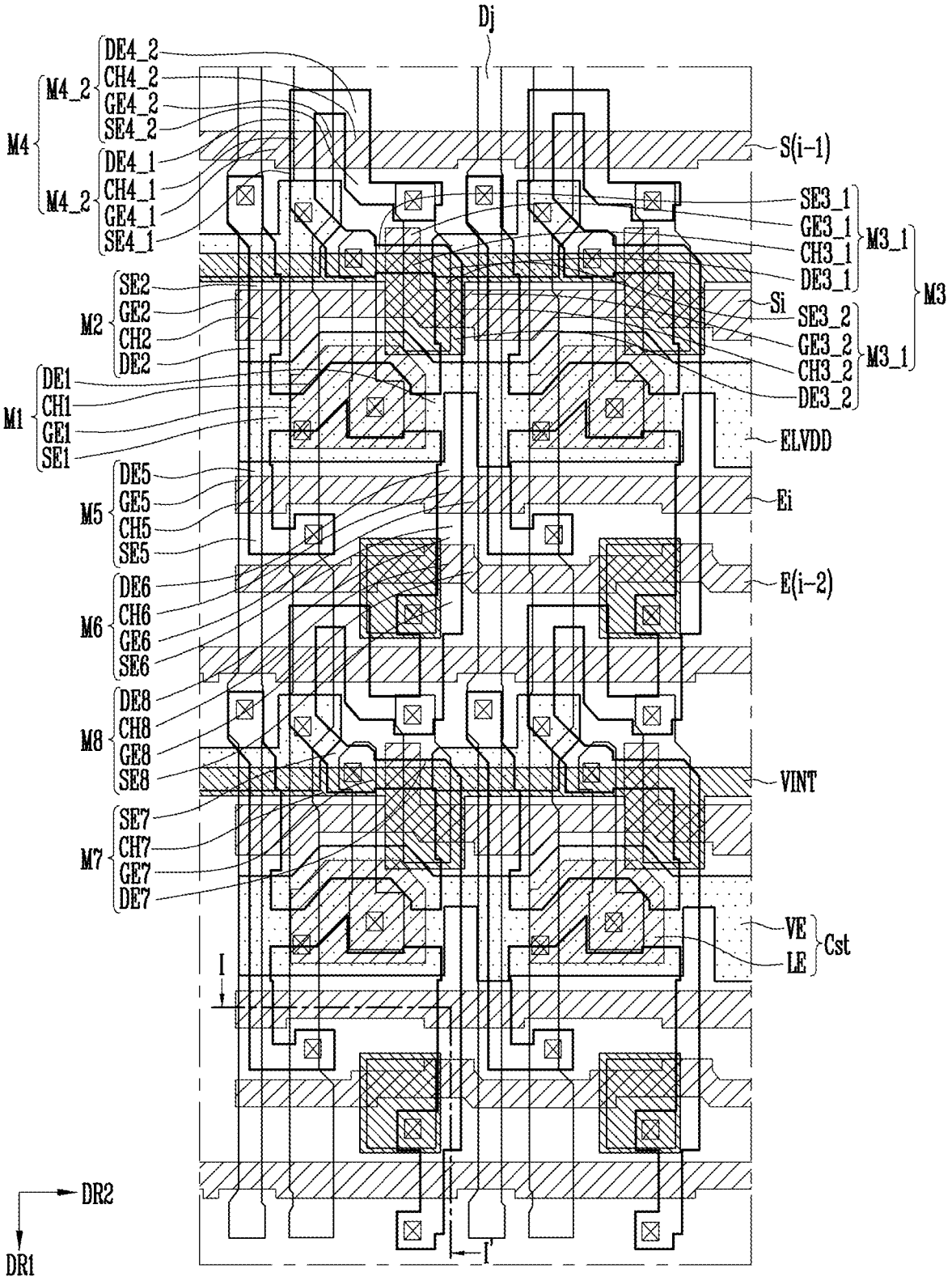
FIG. 8 is a view for explaining an example layout of a pixel circuit according to some example embodiments of the present disclosure.
Figure 9:
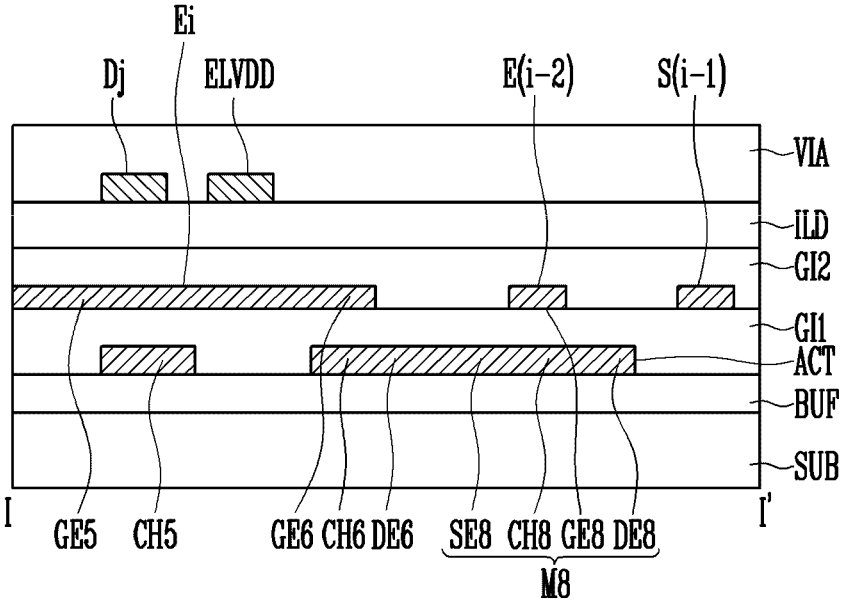
FIG. 9 is a cross-sectional view taken along the line I-I' of FIG. 8.

FIG. 8 is a view for explaining an example layout of a pixel circuit according to some example embodiments of the present disclosure. In particular, FIG. 8 shows the layout of a pixel circuit in which the third transistor M3 is configured with sub-transistors M3_1 and M3_2 and in which the fourth transistor M4 is configured with sub-transistors M4_1 and M4_2, as shown in FIG. 3. FIG. 9 is a cross-sectional view taken along the line I-I' of FIG. 8.

Referring to FIG. 8 and FIG. 9, a substrate SUB may be a rigid substrate or a flexible substrate.

The rigid substrate may include a glass substrate, a quartz substrate, a glass ceramic substrate, and a crystalline glass substrate.

The flexible substrate may include a film substrate including a polymer organic material and a plastic substrate including a polymer organic material. For example, the flexible substrate may include one of polyethersulfone (PES), polyacrylate, polyetherimide (PEI), polyethylene naphthalate (PEN), polyethylene terephthalate (PET), polyphenylene sulfide (PPS), polyarylate (PAR), polyimide (PI), polycarbonate (PC), triacetate cellulose (TAC), and cellulose acetate propionate (CAP). Also, the flexible substrate may include fiber glass reinforced plastic (FRP).

A buffer layer BUF may cover the substrate SUB. The buffer layer BUF may prevent impurities from diffusing into an active layer ACT from the substrate SUB. The buffer layer BUF may be an inorganic insulating layer. For example, the buffer layer BUF may be made of silicon nitride ($SiN_x$), silicon oxide ($SiO_x$), silicon oxynitride ($SiO_xN_y$), or a combination thereof, and may be omitted depending on the material of the substrate SUB and process conditions.

The active layer ACT may be provided on the buffer layer BUF. The active layer ACT may be made of a semiconductor material. For example, the active layer ACT may include polysilicon, amorphous silicon, oxide semiconductor, and the like. The portion that is not doped with an impurity in the active layer ACT configures the channels CH1 to CH7 of the transistors M1 to M7, and the portion doped with an impurity in the active layer ACT may configure electrodes SE1 to SE7 and DE1 to DE7 or lines. The impurity may be a p-type impurity. According to some example embodiments, the impurity may be at least one of a p-type impurity, an n-type impurity, or metal.

A first gate insulating layer GI1 may cover the substrate SUB and the active layer ACT. The first gate insulating layer GI1 may cover the source electrodes SE1 to SE7 of the transistors M1 to M7, the drain electrodes DE1 to DE7 thereof, and the channels CH1 to CH7 thereof. The first gate insulating layer GI1 may be an inorganic insulating layer. For example, the first gate insulating layer GI1 may be made of silicon nitride ($SiN_x$), silicon oxide ($SiO_x$), silicon oxynitride ($SiO_xN_y$), or a combination thereof.

The gate electrodes GE1 to GE7 of the transistors M1 to M7, the first to third scan lines Si, S(i−1), and S(i−2), the first and second emission lines Ei and E(i−1), the initialization power source VINT, and the first electrode LE of the storage capacitor Cst may be located on the first gate insulating layer GI1. The electrodes and lines on the first gate insulating layer GI1 may be made of the same conductive material. For example, the electrodes and lines on the first gate insulating layer GI1 may be made of molybdenum (Mo), titanium (Ti), aluminum (Al), silver (Ag), gold (Au), copper (Cu), or a combination thereof.

A second gate insulating layer GI2 may cover the first gate insulating layer GI1, the gate electrodes GE1 to GE7 of the transistors M1 to M7, the first to third scan lines Si, S(i−1), and S(i−2), the first and second emission lines Ei and E(i−1), the initialization voltage line VINT, and the first electrode LE of the storage capacitor Cst. The second gate insulating layer GI2 may be an inorganic insulating layer. For example, the second gate insulating layer GI2 may be made of silicon nitride ($SiN_x$), silicon oxide ($SiO_x$), silicon oxynitride ($SiO_xN_y$), or a combination thereof.

The second electrode UE of the storage capacitor Cst may be located on the second gate insulating layer GI2. For example, the second electrode UE of the storage capacitor Cst may be made of molybdenum (Mo), titanium (Ti), aluminum (Al), silver (Ag), gold (Au), copper (Cu), or a combination thereof.

An interlayer insulating layer ILD may cover the second gate insulating layer GI2 and the second electrode UE of the storage capacitor Cst. The interlayer insulating layer ILD may be an inorganic insulating layer. For example, the interlayer insulating layer ILD may be made of silicon nitride ($SiN_x$), silicon oxide ($SiO_x$), silicon oxynitride ($SiO_xN_y$), or a combination thereof.

The data line Dj and the power supply line of the first power source ELVDD may be located on the interlayer insulating layer ILD. The electrodes and lines on the interlayer insulating layer ILD may be made of the same material. For example, the electrodes and lines on the interlayer insulating layer ILD may be made of molybdenum (Mo), titanium (Ti), aluminum (Al), silver (Ag), gold (Au), copper (Cu), or a combination thereof.

A via layer VIA may cover the interlayer insulating layer ILD, the data line Dj, and the power supply line of the first power source ELVDD. The via layer VIA may be an organic insulating layer. For example, the via layer VIA may include at least one of polystyrene, polymethylmethacrylate (PMMA), polyacrylonitrile (PAN), polyimide (PA), polyimide (PI), polyarylether (PAE), heterocyclic polymer, parylene, epoxy, benzocyclobutene (BCB), siloxane-based resin, or silane-based resin. In some example embodiments, the via layer VIA may be an inorganic insulating layer, or a multi-layer structure in which an organic insulating layer and an inorganic insulating layer are alternately stacked.

The second scan line S(n−1), the first scan line Sn, the first emission line Ei, and the second emission line E(i−2) may be sequentially located in a first direction DR1 on the same plane. The second scan line S(n−1), the first scan line Sn, the first emission line Ei, and the second emission line E(i−2) may extend in a second direction DR2.

The second emission line E(i−2) may perpendicularly overlap the source electrode SE8 and the drain electrode DE8 of the eighth transistor M8. In other words, the second emission line E(i−2) may perpendicularly overlap a part that is in contact with the source electrode SE8 and the drain electrode DE8 of the eighth transistor M8.

The pixel circuit according to some example embodiments of the present disclosure is configured to set the driving transistor thereof to an on-bias state, thereby preventing unintended light emission and generation of overcurrent and reducing power consumption.

While aspects of some example embodiments of the present disclosure have been described in some detail with reference to the drawings, it will be understood by those skilled in the art that the present disclosure can be implemented in other specific forms without changing the technical spirit or essential features of the present disclosure. Therefore, it should be noted that the forgoing embodiments are merely illustrative in all aspects and are not to be construed as limiting the present disclosure. The scope of the present disclosure is defined by the appended claims, and their equivalents, rather than the detailed description of the present disclosure. All changes or modifications or their equivalents made within the meanings and scope of the claims, and their equivalents, should be construed as falling within the scope of the present disclosure.

What is claimed is:

1. A pixel circuit, comprising:

an organic light-emitting diode;

a first transistor coupled between a second node and a third node, wherein a gate electrode of the first transistor is coupled to a first node;

a second transistor coupled between a data line and the second node, wherein a gate electrode of the second transistor is coupled to a first scan line;

a fourth transistor coupled between the first node and an initialization power source, wherein a gate electrode of the fourth transistor is coupled to a second scan line;

a fifth transistor coupled between a first power source and the second node, wherein a gate electrode of the fifth transistor is coupled to a first emission line; and a sixth transistor and an eighth transistor coupled in series between the third node and the organic light-emitting diode, wherein a gate electrode of the sixth transistor is coupled to the first emission line, and a gate electrode of the eighth transistor is coupled to a second emission line, wherein a phase of a first emission signal applied to the first emission line is delayed relative to a phase of a second emission signal applied to the second emission line.

2. The pixel circuit according to claim 1, wherein:

the sixth transistor is coupled between the third node and one electrode of the eighth transistor, and the eighth transistor is coupled between one electrode of the sixth transistor and the organic light-emitting diode.

3. The pixel circuit according to claim 1, wherein:

the eighth transistor is coupled between the third node and one electrode of the sixth transistor, and the sixth transistor is coupled between one electrode of the eighth transistor and the organic light-emitting diode.

4. The pixel circuit according to claim 1, further comprising:

a third transistor coupled between the first node and the third node and configured such that a gate electrode thereof is coupled to the first scan line.

5. The pixel circuit according to claim 4, wherein:

the third transistor includes a plurality of third sub-transistors coupled in series between the first node and the third node, and the fourth transistor includes a plurality of fourth sub-transistors coupled in series between the first node and the initialization power source.

6. The pixel circuit according to claim 1, wherein a phase of a first scan signal applied to the first scan line is delayed relative to a phase of a second scan signal applied to the second scan line.

7. The pixel circuit according to claim 6, wherein:

a turn-on level pulse of the first scan signal overlaps a turn-off level pulse of the first emission signal, and a turn-on level pulse of the second scan signal overlaps a turn-off level pulse of the second emission signal.

8. The pixel circuit according to claim 7, wherein the turn-on level pulse of the second scan signal is generated when the first emission signal is at a turn-on level.

9. The pixel circuit according to claim 1, further comprising:

a seventh transistor coupled between the initialization power source and the organic light-emitting diode, wherein a gate electrode of the seventh transistor is coupled to a third scan line.

10. The pixel circuit according to claim 9, wherein a phase of a third scan signal applied to the third scan line is identical to a phase of a second scan signal applied to the second scan line.

11. The pixel circuit according to claim 9, wherein a phase of a second scan signal applied to the second scan line is delayed relative to a phase of a third scan signal applied to the third scan line.

12. The pixel circuit according to claim 9, wherein a phase of a third scan signal applied to the third scan line is delayed relative to a phase of a second scan signal applied to the second scan line.

13. The pixel circuit according to claim 9, further comprising:

a first gate insulating layer covering source electrodes, drain electrodes, and channels of the first, second, fourth to sixth, and eighth transistors, wherein the gate electrodes of the first, second, fourth to sixth, and eighth transistors, the first and second scan lines, and the first and second emission lines are on the first gate insulating layer.

14. The pixel circuit according to claim 13, wherein the second scan line, the first scan line, the first emission line, and the second emission line are sequentially arranged in a first direction on an identical plane.

15. The pixel circuit according to claim 14, wherein the second emission line perpendicularly overlaps the source electrode and the drain electrode of the eighth transistor.

16. The pixel circuit according to claim 1, further comprising:

a storage capacitor coupled between the first power source and the first node.

* * * * *